US010636351B2

(12) United States Patent
Cobb et al.

(10) Patent No.: US 10,636,351 B2
(45) Date of Patent: Apr. 28, 2020

(54) CONFORMABLE MATRIX DISPLAY DEVICE

(71) Applicants: Nederlandse Organisatie voor toegepast-natuurwetenschappelijk onderzoek TNO, s-Gravenhage (NL); IMEC vzw, Leuven (BE)

(72) Inventors: Brian Hardy Cobb, Cambridge (GB); Jan Genoe, Testelt (BE)

(73) Assignees: Nederlandse Organisatie voor toegepast-natuurwetenschappelijk onderzoek TNO, 's-Gravenhage (NL); IMEC vzw, Leuven (BE)

( * ) Notice: Subject to any disclaimer, the term of this patent is extended or adjusted under 35 U.S.C. 154(b) by 0 days.

(21) Appl. No.: 16/303,327

(22) PCT Filed: May 26, 2017

(86) PCT No.: PCT/NL2017/050337

§ 371 (c)(1),
(2) Date: Nov. 20, 2018

(87) PCT Pub. No.: WO2017/204641

PCT Pub. Date: Nov. 30, 2017

(65) Prior Publication Data

US 2019/0213947 A1 Jul. 11, 2019

(30) Foreign Application Priority Data

May 26, 2016 (EP) ..... 16171507

(51) Int. Cl.
*G09G 3/32* (2016.01)
*G09G 3/20* (2006.01)
(Continued)

(52) U.S. Cl.
CPC ..... *G09G 3/32* (2013.01); *G09G 3/2085* (2013.01); *G09G 3/3233* (2013.01);
(Continued)

(58) Field of Classification Search
None
See application file for complete search history.

(56) References Cited

U.S. PATENT DOCUMENTS 5,510,807 A * 4/1996 Lee ..... G09G 3/3688 345/103
6,016,038 A 1/2000 Mueller et al.
(Continued)

FOREIGN PATENT DOCUMENTS

| | | | |
|---|---|---|---|
| EP | 2 713 357 | A1 | 4/2014 |
| WO | 2008/001274 | A2 | 1/2008 |
| WO | 2010046638 | A1 | 4/2010 |

OTHER PUBLICATIONS

Aug. 30, 2017—International Search Report App. PCT/NL2017/050337.
Nov. 1, 2016—(EP) Search Report—App. 16171507.3.

*Primary Examiner* — Duane N Taylor, Jr.
(74) *Attorney, Agent, or Firm* — Banner & Witcoff, Ltd.

(57) ABSTRACT

A conformable matrix display device is provided with row conductors on the conformable carrier, each for a respective row of the matrix of pixel circuits. Each row conductor has serpentine trajectories in spaces between the pixel circuits in the respective row. Power supply voltage and selection pulse signals are transmitted over the same row conductors. Each row conductor is connected to supply voltage and selection inputs of the pixel circuits in the respective row. Each pixel circuit has a pulse transmission circuit coupled between the selection input and the control input of a de-multiplexing circuit for de-multiplexing data signals on column conductors. In this way the power supply voltage and the selection signal can be supplied making shared use of space between the pixel circuits. Thus the number of conductors in the matrix display device is reduced, which enables a greater distance between the conductors and/or bends in the con-
(Continued)

ductors, which makes the circuit more stretchable and/or bendable.

8 Claims, 4 Drawing Sheets

(51) Int. Cl.
*G09G 3/3266* (2016.01)
*G09G 3/3233* (2016.01)

(52) U.S. Cl.
CPC ... *G09G 3/3266* (2013.01); *G09G 2300/0426* (2013.01); *G09G 2300/0465* (2013.01); *G09G 2300/0871* (2013.01); *G09G 2310/0297* (2013.01); *G09G 2320/0626* (2013.01); *G09G 2380/02* (2013.01)

(56) References Cited

U.S. PATENT DOCUMENTS

| | | | | |
|---|---|---|---|---|
| 8,004,480 | B2 * | 8/2011 | Kim | G09G 3/3291 345/76 |
| 8,319,761 | B2 * | 11/2012 | Lee | G09G 3/20 345/204 |
| 2012/0043906 | A1 | 2/2012 | Jones | |
| 2013/0248829 | A1 | 9/2013 | Smith | |
| 2014/0138637 | A1 | 5/2014 | Yang et al. | |
| 2014/0168037 | A1 | 6/2014 | Sakariya et al. | |
| 2016/0019834 | A1 * | 1/2016 | Hall | G09G 3/3208 345/212 |

* cited by examiner

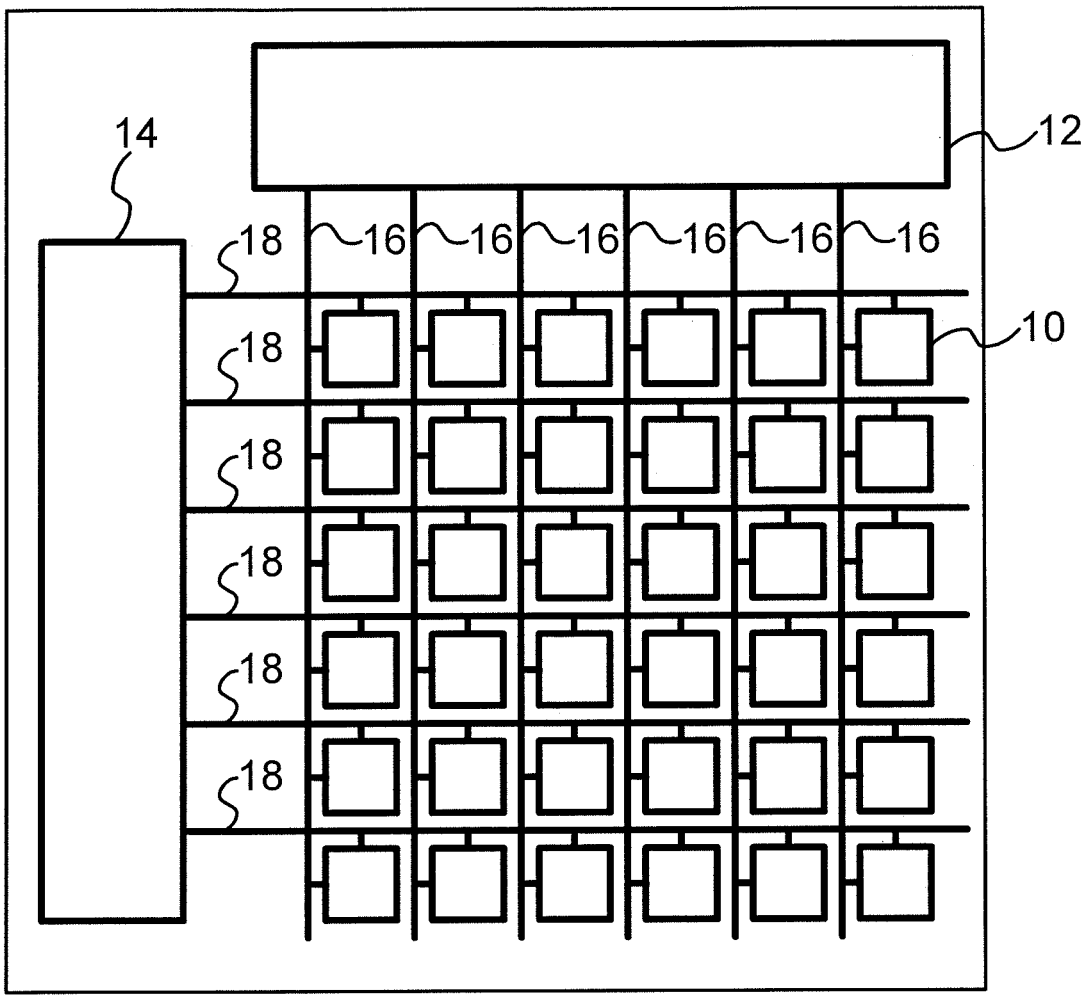
Fig.1
Fig.1a
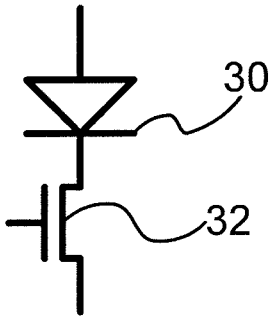

CONFORMABLE MATRIX DISPLAY DEVICE

CROSS-REFERENCE TO RELATED APPLICATIONS

This application is a U.S. National Stage application under 35 U.S.C. § 371 of International Application PCT/NL2017/050337 (published as WO 2017/204641 A1), filed May 26, 2017, which claims the benefit of priority to Application EP 16171507.3, filed May 26, 2016. Benefit of the filing date of each of these prior applications is hereby claimed. Each of these prior applications is hereby incorporated by reference in its entirety.

FIELD OF THE INVENTION

The invention relates to a conformable matrix display device and a method of making a matrix display that can be stretched or bent after manufacture without making it inoperable.

BACKGROUND

A conformable device is a device that can be stretched and/or bent to different shapes without making it inoperable. To make a matrix display device conformable, its individual pixel circuits are provided on a conformable substrate, or other conformable connecting structure such as connections between the pixel circuits. However, this does not yet ensure conformability because conductor tracks on the conformable connecting structure may break as a result of stretching or bending.

It is known to reduce the strain of conductor track due to stretching by using serpentine conductor tracks, i.e. tracks whose direction varies along the track, usually returning to the same directions via intermediate bends. Successive bends in the shape of circle segments may be used for example. The display area of such a device comprises islands containing the individual pixel circuits, surrounded by areas that accommodate the serpentine conductor tracks. When the device is stretched the areas containing the serpentine conductor tracks are strained, but with a lower strain than would be experienced by straight tracks. However, the need to accommodate for the serpentine conductor tracks surrounding the pixel circuits limits the maximum possible pixel density.

SUMMARY

Among others, it is an object to increase the pixel density of a conformable matrix display device.

A conformable matrix display device is provided, comprising

- a conformable carrier;
- a matrix of pixel circuits on the conformable carrier, each pixel circuit comprising
  - a first and second supply voltage input;
  - a light intensity control circuit coupled between the first and second supply voltage input;
  - a data signal input;
  - a data signal storage element coupled to a control input of the light intensity control circuit;
  - a de-multiplexing circuit coupled between the data signal input and the data signal storage element, the de-multiplexing circuit having a control input for controlling transfer of a data signal from the data signal input to the data signal storage element;

- row conductors on the conformable carrier, each for a respective row of the matrix of pixel circuits, each row conductor having serpentine trajectories in spaces between the pixel circuits in the respective row, each of said row conductors connected to the first supply voltage inputs of the pixel circuits in the respective row; wherein
  - each pixel circuit has a pulse transmission circuit coupled between the row conductor of the row in which the pixel circuit is located and the control input of the de-multiplexing circuit.

In this way the power supply voltage and the selection signal can be supplied making shared use of the space between the pixel circuits. The pulse transmission circuit is configured to cause the de-multiplexing circuit to transfer a data signal from the data signal input to the data signal storage element in response to a pulse superimposed on a supply voltage on the row conductor coupled to the first supply voltage input of the pixel circuit. More room for the serpentine trajectory is created by using the same row conductor to supply the power supply voltage and the selection signal. Space on the conformable carrier that would be taken up by separate row conductors for power supply voltage and selection voltages if separate row conductors were used is made available for the row conductor.

Thus the number of conductors in the matrix display device is reduced, which enables a greater distance between the conductors and/or bends in the conductors, which increases the stretchability of the device and the manufacturing yield.

In an embodiment the device comprises further row conductors on the conformable carrier, each for a respective row of the matrix of pixel circuits, each further row conductor having serpentine trajectories in spaces between the pixel circuits in the respective row, each of said row conductors connected to the second supply voltage inputs of the pixel circuits in the respective row. Because the first power supply connection and the select signal use the same row conductor, more space is left for a serpentine second power supply conductor (e.g. ground). In an embodiment a plurality of serpentine column conductors may be used, e.g. to supply data signals for different colors, which are selected by the same select signal. These also profit from the reduction of the number of required conductors.

A conformable matrix display device is provided, comprising

- a conformable carrier;
- a matrix of pixel circuits on the conformable carrier, each pixel circuit comprising
  - a first and second supply voltage input;
  - a light intensity control circuit coupled between the first and second supply voltage input;
  - a data signal input;
  - a data signal storage element coupled to a control input of the light intensity control circuit;
  - a de-multiplexing circuit coupled between the data signal input and the data signal storage element;
  - a selection input coupled to a control input of the de-multiplexing circuit;
- row conductors on the conformable carrier, each for a respective row of the matrix of pixel circuits, each row conductor having serpentine trajectories in spaces between the pixel circuits in the respective row, each of said row conductors connected to both the first supply voltage inputs and selection inputs of the pixel circuits in the respective row; wherein each pixel circuit has a pulse transmission circuit coupled between the selection input and the control input of the de-multiplexing circuit, configured to cause the de-multiplexing circuit transfer a data signal from the data signal input to the data signal storage element in response to a pulse superimposed on a supply voltage on the row conductor coupled to the first supply voltage input.

BRIEF DESCRIPTION OF THE DRAWING

These and other advantageous aspects will become apparent from a description of exemplary embodiments with reference to the following drawing.

FIG. 1 schematically shows a top view of a matrix display device

FIG. 1*a* shows part of a pixel circuit

DETAILED DESCRIPTION OF EXEMPLARY EMBODIMENTS

Figure 2:
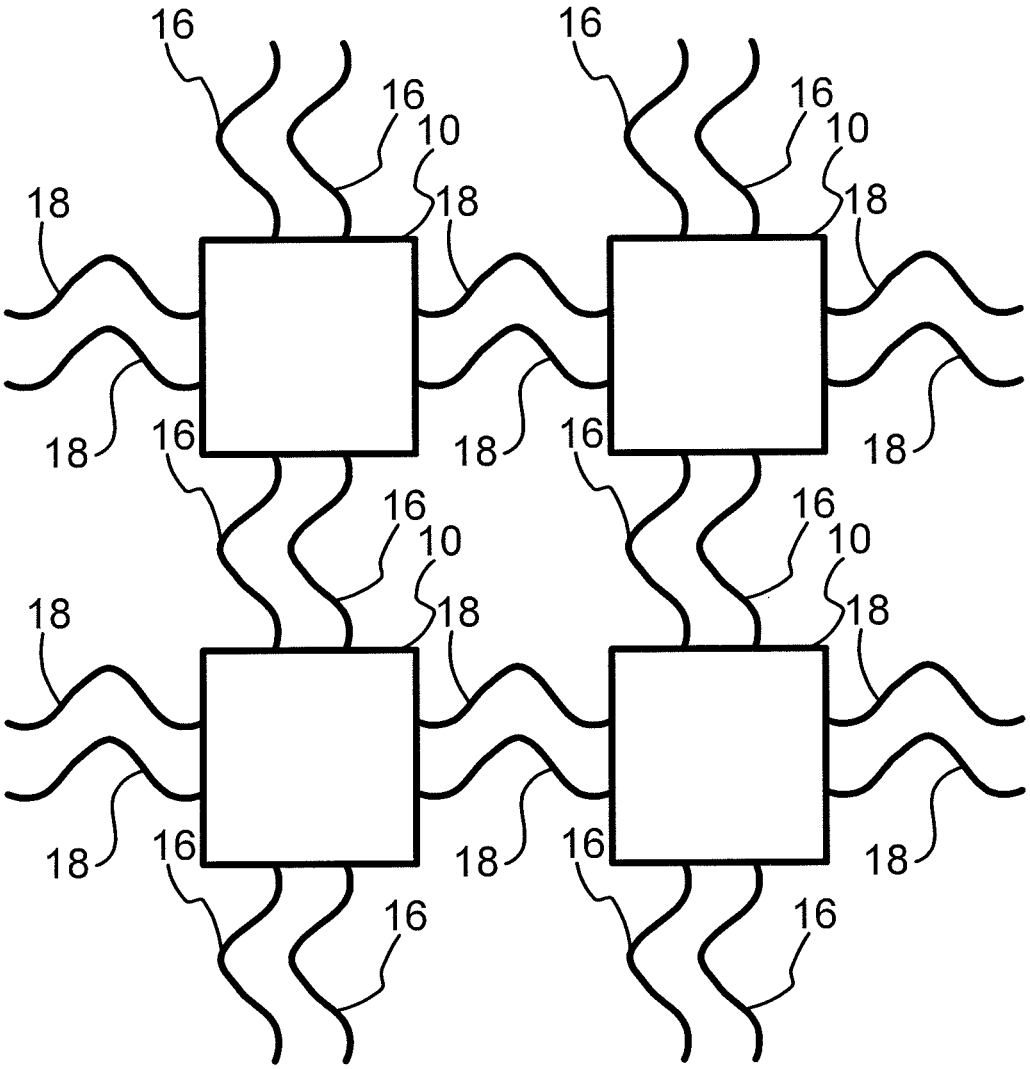
FIG. 2 shows a detail of layout of conductors between pixel circuits

Preferably, the matrix display device is conformable in the sense that it can be stretched by at least a half percent and preferably at least a percent without malfunctioning and/or if it can be bent to a radius of curvature of at less than a hundred millimeter without malfunctioning. The conformable device need not be both bendable and stretchable in this sense. For a number of applications devices that are stretchable in this sense without being bendable in this sense suffice and for others devices that are bendable in this sense without being stretchable in this sense may suffice.

FIG. 1 schematically shows a matrix display device comprising an array of pixel circuits 10 (only one labeled), a column control circuit 12, a row control circuit 14, column conductors 16 and column conductors 18. As is conventional, the terms "row" and "column" are used to distinguished different directions in the matrix, without implying a physical direction. Thus, a "column" in the matrix may correspond to a vertical line or a horizontal line in a displayed image. For the sake of illustration column conductors 16 and row conductors 18 are shown running adjacent to pixel circuits 10, but it should be appreciated that in practice they may run through pixel circuits 10. As used herein, "conductor" is used to refer to a conductor in the form of conductor line (longer than wide), preferably, but not necessarily of constant width although it may connect to broader or narrower patches, and which may be straight or curved or run through angles.

For the sake of illustration, a single column conductor 16 and row conductor 18 is shown for each column and row of pixel circuits respectively, although in practice more than one column conductor 16 and/or row conductor 18 may be used per column or row. Each column conductor 16 connects column control circuit 12 to a respective column of pixel circuits 10. Each row conductor 18 connects row control circuit 14 to a respective row of pixel circuits 10. Although not shown in the schematic, the circuit also requires one or more ground conductors to couple all pixel circuits to ground. The ground conductors may run along the columns and or along the rows. Although a ground connection may in theory be provided in the form of a ground plane that covers the entire matrix area, ground conductors (lines) are preferred to realize sufficiently low electrical resistance while avoiding ground plane bending and/or stretching problems.

Each pixel circuit may be a LED pixel circuit. FIG. 1*a* shows core elements of a LED pixel circuit: a LED 30 and a transistor 32 with its main current channel coupled in series with the LED. A control voltage at the control electrode of transistor 32 controls the current through LED 30 and the main current channel of transistor 32 between two power supply inputs. The current determines the light intensity emitted by LED 30. Two power supply connections and a control signal input are needed to support LED emission with a controllable light intensity from LED 30.

In a matrix display, the control signals for pixel circuits in different rows along a same column are time multiplexed. Supply of the control signal requires two signals to be supplied to the pixel circuit: a data signal may be used to define the level of the control signal and a select signal may be used to indicate when the data signal is be used to define the level of the control signal. The data signal is supplied to a column of pixel circuits. The control signals for the different pixel circuits in the column are time multiplexed in the data signal. Different select signals are supplied to different rows of pixel circuits to control de-multiplexing.

In all four independent voltages need to be supplied to such a pixel circuit: the data signal, the select signal and two supply voltages (including ground). More complex pixel circuits need more voltages. For example a pixel circuit with three different color LEDs may need three data signals, a select signal and two power supply voltages, or a data signal, three select signals and two power supply voltages. Conductor lines are used to supply the voltages through the matrix to the pixel circuits.

At least pixel circuits 10, column conductors 16 and column conductors 18 are located on a bendable and/or stretchable substrate (not labeled). The substrate is preferably stretchable in the sense that the substrate is of a material that does not break when stretched by at least a half percent and preferably at least a percent e.g. between opposite ends of the substrate. The substrate is preferably bendable in the sense that the substrate is of a material that does not break when bent such that there is a radius of curvature of at less than a hundred millimeter. The matrix display may have a size of at least 10 millimeter by 10 millimeter for example. Bending with a radius of curvature of 100 millimeter between points that are 10 millimeter apart results in an angle of about six degrees between the surface directions at these points. The substrate need not be both bendable and stretchable in this sense. For a number of applications a stretchable substrate in this sense suffices and for others a bendable substrate in this sense may suffice, although of course stretchability and bendability may be related.

FIG. 2 shows a detail of a layout of row and column conductors 16, 18 between pixel circuits 10. By way of example, two column conductors 16 and row conductors 18 are shown per row and column. Pixel circuits 10 are shown schematically as rectangles with spaces between adjacent pixel circuits. In the spaces, the trajectories of conductors 16, 18 between adjacent pixel circuits contain one or more loops (a loop as used herein is a curve that forms the part or all of edge of an area through which different points along the curve could be connected by a straight line, where the curves may bend continuously or may have angles at discrete points possibly with straight parts in between (zigzag trajectories)). As used herein a trajectory with at least one such loop in the space between successive pixel circuits will be called a serpentine trajectory. At least part of each area whose edge is at least partly formed by such a loop does not contain an obstruction (other than possibly another loop) that prevents use of a straight conductor between points on the loop.

Compared to straight lines, serpentine trajectories with loops in the spaces between pixel circuits serve to reduce the overall strain of conductors 16, 18 when the substrate is bent or stretched. This is known per se. By way of example conductors 16, 18 with curved trajectories are shown with loops that run along circle segments. But alternatively other serpentine trajectories may be used, such as zig-zag lines or sine function shaped lines, or braided combinations of loops.

The pixel circuits 10 may be located in a rectangular matrix, in which case pixel circuits 10 in different rows and columns are located at equidistant locations along virtual straight lines corresponding to the rows and columns of the matrix, the pixel circuits 10 along each line being connected to the same row or column conductor. But the matrix need not be rectangular. Alternatively, they the pixel circuits located in a periodically repeating pattern of different offsets with respect to such straight lines. In this way a hexagonal matrix may be realized for example, or different pixels circuits for producing different color spectra, which are notionally in different columns, may be located closer to each other than when they are in geometrically distinct rows.

In operation, column control circuit 12 and row control circuit 14 supply column data signals and row selection signals to the pixel circuits 10 via column and row conductors 16, 18. The data signals on different column conductors 16 define light intensities for different columns in parallel, temporally in series for different rows. The selection signals on different row conductors 18 define when the data signals are intended for particular rows. Row control circuit 14 successively indicates selection of different rows and column control circuit 12 supplies the data signals for the selected rows when the rows are selected.

An embodiment will be described wherein row conductors 18 are used both to supply a power supply voltage and the row selection signals. The row selection signal to a row conductor 18 is provided when the row is selected. The power supply voltage is supplied also when other rows are selected and preferably substantially permanently.

Figure 3:
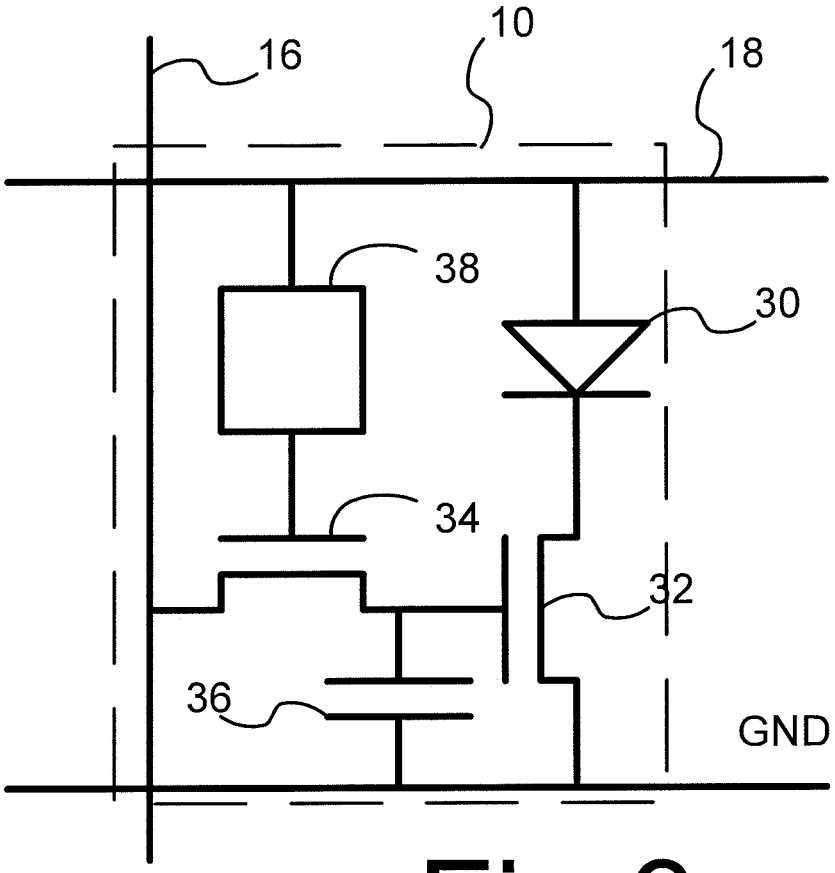
FIG. 3 shows a pixel circuit

FIG. 3 shows a pixel circuit 10 with a single LED (Light Emitting Diode) for controlling light emission using a power supply voltage and a row selection signal supplied over the row conductor 18 of the row to which pixel circuit 10 belongs. In other embodiments, a pixel circuit 10 may comprise multiple LEDs, e.g. with different color emission spectra.

The illustrated pixel circuit 10 comprises a LED 30, a control transistor 32, a switching transistor 34, a storage capacitor 36 and a pulse transmission circuit 38. LED 30 and control transistor 32 function as a light intensity control circuit coupled between the supply voltage inputs. LED 30 and the main current channel of control transistor 32 are connected in series between row conductor 18 and ground (GND). Switching transistor 34 serves as a simple demultiplexing circuit. The main current channel of switching transistor 34 is connected between the control electrode of control transistor 32 and the column conductor 16 of the column to which pixel circuit 10 belongs. Storage capacitor 36 serves as a data signal storage element. Storage capacitor 36 is connected between the control electrode of control transistor 32 and ground (GND). Pulse transmission circuit 38 is coupled between the control electrode of switching transistor 34 and row conductor 18. In the illustrated circuit, ground (GND) is shown as a further row conductor, but alternatively ground may be realized as a column conductor or a combination of a row conductor and a column conductor.

In operation, storage capacitor 36 serves to maintain a voltage that causes control transistor 32 to control the current through LED 30 at a level determined by the voltage over storage capacitor 36. Switching transistor 34 connects storage capacitor 36 to the column conductor 16 of the column to which pixel circuit 10 belongs, when the row selection signal is supplied via the row conductor 18.

Figure 4:
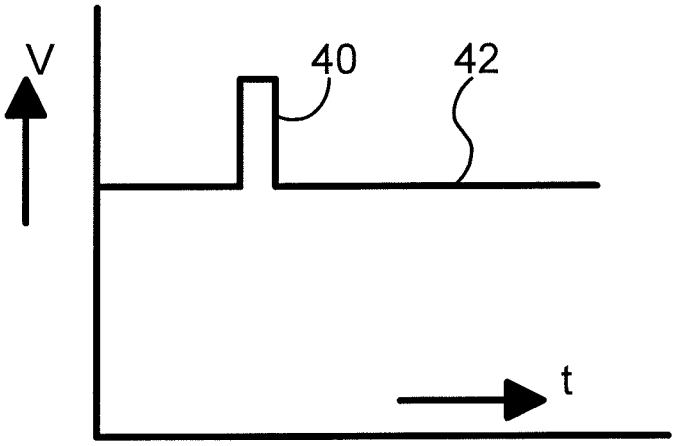
FIG. 4 shows a row conductor voltage as a function of time

FIG. 4 shows the voltage level "V" on the row conductor relative to ground as a function of time "t". The row selection signal is supplied as a pulse 40 superimposed on a power supply voltage level 42. The power supply voltage level 42 enables current flow through LED 30 from row conductor 18.

Pulse transmission circuit 38 generates a control signal on the control electrode of switching transistor 34 in response to pulse 40, to make switching transistor 34 establish a conductive connection between storage capacitor 36 and column conductor 16 during pulse 40, and to cause switching transistor 34 to isolate storage capacitor 36 from column conductor 16 outside pulse 40, or al least at more than a predetermined time distance from pulse 40. Thus, a pulse 40 superimposed on power supply voltage level 42 on row conductor 18 is used to control an update of the voltage over storage capacitor 36. When control transistor 32 is used as a current regulator, pulse 40 does not affect light transmission by LED 30 other than through its effect on switching transistor 34. But even if control transistor 32 is used in it controllable resistor range, the effect on average light transmission by LED 30 is small, because pulse 40 occurs only during a fraction of the time during which light is emitted.

In the illustrated embodiment, switching transistor 34 is of a type wherein the main current channel becomes conductive only when the voltage at its control gate is raised above (the lowest of) the voltages on column conductor 16 and the control electrode of control transistor 32 plus a threshold value. In the absence of pulse 40 pulse transmission circuit 38 keeps the voltage at the control gate of switching transistor 34 at a first voltage level, below the lowest used voltage on column conductor 16 plus the threshold value. In response to pulse 40 pulse transmission circuit 38 raises the voltage at the control gate of switching transistor 34 to a second voltage level above the highest used voltage on column conductor 16 plus the threshold value.

In an embodiment, a pixel circuit may be used that comprises a plurality of independently controllable LEDs. Such a circuit may comprise a plurality of circuits like that of FIG. 3 connected to a shared row conductor and respective different column conductors. The pulse transmission circuit 38 may be shared as well, so that change transmission circuit 38 may have its output coupled to the control electrodes of a plurality of switching transistors of the plurality of circuits like that of FIG. 3.

By way of example, a level shift circuit may be used for pulse transmission circuit 38, to reproduce the changes of the voltage level on row conductor 18 on the control electrode of switching transistor 34, but with shifted voltage levels. In a simple embodiment, the level shift circuit may comprise a further capacitor connected between row conductor 18 and the control electrode of switching transistor 34 and a bleeder resistance coupled between the control electrode of switching transistor 34 and ground. In such a circuit the voltage on the control electrode of switching transistor 34 follows the voltage on row conductor 18 with an offset equal to the voltage over the further capacitor. The bleeder resistance may be implemented as a main current channel of a transistor, e.g. transistor of which the control electrode is connected to a terminal of its main current channel. The bleeder resistance serves to charge the further capacitor to the voltage difference between the average supply voltage row conductor 18 and ground. Its resistance value is so large that the RC time defined by the bleeder resistor and the further capacitor is much larger than the pulse width of the select pulse 40 (e.g. at least ten times as large). Instead of a further capacitor any high pass filter may be used, for example a passive high pass filter.

Such a level shift circuit with a further capacitor or a passive high pass filter has the advantage that is does not significantly increase the current supply requirements for row conductor 18. Instead of such a level shift circuit other types of pulse transmission circuits may be used. Such a pulse transmission circuits may another type of level shift circuit, e.g. using transistors, resistors and/or diodes. Level shift circuits are known in the prior art. Instead of a pulse amplitude preserving level shift circuit pulse transmission circuit 38 may be a pulse amplitude amplifying or attenuating circuit, or a pulse generator circuit that is configured to transmit a newly generated pulse in response to the pulse on the row conductor, as long as a pulse is provided on the control electrode of switching transistor 34 that is sufficient to switch switching transistor 34 between a non-conductive and a conductive state.

Although embodiments have been discussed wherein pulse 40 on row conductor 18 is of the same polarity as the pulse on the control electrode of switching transistor 34, it should be appreciated that instead opposite a polarities may be used when an inverting pulse transmission circuit 38 is used.

Although a de-multiplexing circuit in the form of switching transistor 34 for de-multiplexing the control signals from the data signal on the column conductor has been shown by way of illustration, it should be noted that other types of de-multiplexing circuit may be used. For example, switching transistor 34 may be of a different type, e.g. a type wherein the main current channel becomes conductive only when the voltage at its control gate is lowered by more than a threshold amount below (the lowest of) the voltages on column conductor 16 and the control electrode of control transistor 32. In this case a negative pulse may be used on row conductor 18 instead of the positive pulse. A combination of transistors may be used in the de-multiplexing circuit. Instead of a de-multiplexing circuit that enables copying a voltage level from the column conductor, a de-multiplexing circuit may be used that outputs a voltage that is a function of the voltage level from the column conductor. A column voltage driver (not shown) may be used to adapt the column conductor voltage so that a desired voltage is produced at the control electrode of the control transistor.

Although a storage capacitor 36 has been shown as an exemplary data signal storage element, it should be appreciated that alternatively other data signal storage elements may be used, e.g. binary or multi-bit storage elements, or data signal storage elements containing a capacitor in combination with other circuit elements such as one or more transistors.

Although an embodiment has been described wherein storage capacitor 36 is connected between the control electrode of control transistor 32 and ground, it should be appreciated that storage capacitor 36 may be connected between the control electrode of control transistor 32 and any other reference conductor.

Although an embodiment has been described wherein LED 30 and control transistor 32 function as a light intensity control circuit, other types of light intensity control circuit may be used. Although an embodiment has been described wherein LED 30 is connected between row conductor 18 and the main current channel of control transistor 32, it should be appreciated that instead the main current channel of control transistor 32 may be connected between LED 30 and row conductor 18, LED 30 being connected between the main current channel of control transistor 32 and ground. In such embodiments, different voltage levels may need to be used on column conductor 16. In other embodiments the light intensity control circuit may comprise a light modulator such as an LCD cell, or another type of electro-luminescent device instead of the LED, and the control circuit between the control input and the light modulator or electro-luminescent device may be modified accordingly.

Figure 5:
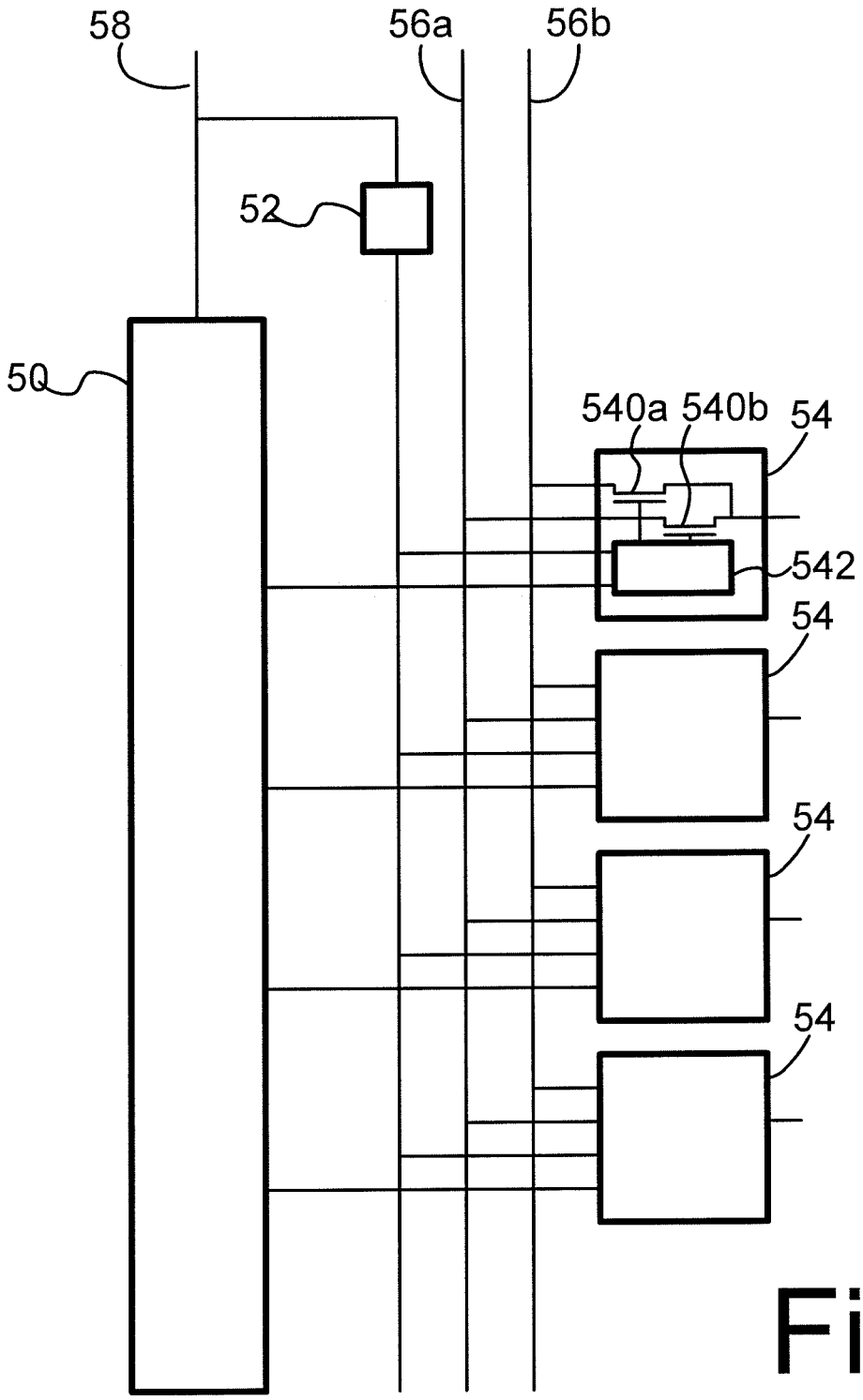
FIG. 5 shows a row control circuit

FIG. 5 shows an illustrative embodiment of row control circuit 14. In this embodiment, row control circuit 14 comprises a row selection circuit 50, a pulse generator 52 and a plurality of row drivers 54. Row control circuit 14 has a first and second power supply input 56*a,b* and a clock input 58. Pulse generator 52 has a pulse circuit input and a pulse output, the pulse circuit input being coupled to clock input 58. Row selection circuit 50 has a plurality of row selection outputs coupled to selection inputs of respective ones of the row drivers 54. Each row driver 54 has voltage inputs coupled to first and second power supply input 56*a,b*, a control input coupled to the pulse output of pulse generator 52 and a voltage output coupled to a respective one of the row conductors 18.

An exemplary internal structure of row drivers 54 is shown for one of the row drivers 54. This row driver 54 comprises a first and second transistor 540*a,b* and a logic circuit 542. Logic circuit 542 has inputs coupled to the selection input of the row driver 54 and to the pulse output of pulse generator 52. First and second transistor 540*a,b* have main current channels connected between the row conductor 18 and the first and second power supply input 56*a,b* respectively. The control electrodes of first and second transistor 540*a,b* are coupled to complementary outputs of logic circuit 542. Logic circuit 542 is configured to make the main current channel of first transistor 540*a* conductive when the row driver 54 is not selected by row selection circuit 50 or (logical "or") the pulse output of pulse generator 52 is not at a pulse level. If not, logic circuit 542 makes the main current channel of first transistor 540*a* non conductive. Logic circuit 542 is configured to control the main current channel of second transistor 540*b* in the opposite way.

In operation, first and second power supply input 56*a,b* supply the power supply voltage level and the power supply plus pulse voltage levels of row conductor 16 respectively. Pulse generator 52 generates pulses to control when pulses will be generated on row conductors 18. Row selection circuit 50 applies selection signals to row drivers 54 to select different row drivers 54 successively. Normally, row drivers 54 connect row conductors 18 to first power supply input 56*a*. But when a row driver 54 is selected and a pulse is generated, the row driver 54 connects its row conductor 18 to first power supply input 56*a*.

It will be appreciated that FIG. 5 merely illustrates an exemplary embodiment of a row control circuit and that different row control circuits may be used instead of this illustrative embodiment of FIG. 5 to produce power supply voltages on row conductors 18 with superimposed pulses on individual selected row conductors.

Although embodiments have been shown with a mode wherein superimposed pulses are applied on individual selected row conductors one at a time, it should be appreciated that the device may support other modes, wherein pulses are superimposed on groups of row conductors 18 or even all row conductors 18 simultaneously. This may be used for example to set a group of rows to the same the light intensity pattern together.

The invention claimed is:

1. A conformable matrix display device, comprising a conformable carrier;

a matrix of pixel circuits on the conformable carrier, each pixel circuit comprising a first and second supply voltage input;

a light intensity control circuit coupled between the first and second supply voltage input;

a data signal input;

a data signal storage element coupled to a control input of the light intensity control circuit;

a de-multiplexing circuit coupled between the data signal input and the data signal storage element, the de-multiplexing circuit having a control input for controlling transfer of a data signal from the data signal input to the data signal storage element;

row conductors on the conformable carrier, each for a respective row of the matrix of pixel circuits, each row conductor having serpentine trajectories in spaces between the pixel circuits in the respective row, each of said row conductors connected to the first supply voltage inputs of the pixel circuits in the respective row; wherein each pixel circuit has a pulse transmission circuit coupled between the row conductor of the row in which the pixel circuit is located and the control input of the de-multiplexing circuit.

2. A conformable matrix display device according to claim 1, further comprising a row selection circuit coupled to the row conductors and configured to supply a supply voltage on the row conductors, with superimposed pulses successively on different selected ones of the row conductors.

3. A conformable matrix display device according to claim 1, wherein the de-multiplexing circuit comprises a switching transistor, with a main current channel coupled between the data signal input and the data signal storage element, the switching transistor having a control electrode coupled to the row conductor via the pulse transmission circuit.

4. A conformable matrix display device according to claim 1, wherein the pulse transmission circuit is voltage level shifting circuit, configured to pass the voltage from the row conductor with the pulse superimposed on a supply voltage to the control input of the de-multiplexing circuit with a voltage level shift.

5. A conformable matrix display device according to claim 1, wherein the light intensity control circuit comprises a LED diode and a control transistor with a main current channel coupled in series with the LED diode between the first and second supply voltage, the control transistor having a control electrode coupled to the data signal storage element.

6. A conformable matrix display device according to claim 1, comprising further row conductors on the conformable carrier, each for a respective row of the matrix of pixel circuits, each further row conductor having serpentine trajectories in spaces between the pixel circuits in the respective row, each of said row conductors connected to the second supply voltage inputs of the pixel circuits in the respective row.

7. A conformable matrix display device according to claim 1, comprising column conductors on the conformable carrier each for a respective column of the matrix of pixel circuits, each column conductor having serpentine trajectories in spaces between the pixel circuits in the respective column, each column conductor connected to the data inputs of the pixel circuits in the respective column.

8. A conformable matrix display device according to claim 1, comprising plurality of column conductors on the conformable carrier for each column of the matrix, wherein each pixel circuit comprises a plurality of light intensity control circuits coupled between the first and second supply voltage input, a plurality of data signal storage elements, and a plurality of de-multiplexing circuits coupled between respective ones of the column conductors for the column wherein the pixel circuit is located, wherein the pulse transmission circuit is coupled to control inputs each of the plurality of de-multiplexing circuits.

* * * * *